US005550704A

United States Patent [19]

Morita et al.

[11] Patent Number: 5,550,704

[45] Date of Patent: Aug. 27, 1996

[54] IGNITION COIL INCLUDING INORGANIC INSULATOR EXHIBITING HIGHER CONDUCTIVITY ALONG ITS SURFACE THAN PERPENDICULAR TO ITS SURFACE

[75] Inventors: Shingo Morita; Yutaka Ohashi, both of Himeji, Japan

[73] Assignee: Mitsubishi Denki Kabushiki Kaisha, Tokyo, Japan

[21] Appl. No.: 276,884

[22] Filed: Jul. 18, 1994

[30] Foreign Application Priority Data

Feb. 25, 1994 [JP] Japan ..... 6-028500

[51] Int. Cl.[6] ..... H01F 27/32

[52] U.S. Cl. ..... 361/263; 336/206; 123/634

[58] Field of Search ..... 361/253, 263, 361/268; 336/96, 107, 206; 123/634

[56] References Cited

U.S. PATENT DOCUMENTS

| | | | |
|---|---|---|---|
| 3,587,168 | 6/1971 | Kolator | 29/605 |
| 3,939,449 | 2/1976 | Boyd et al. | 336/60 |
| 4,013,987 | 3/1977 | Foster | 336/205 |
| 4,268,810 | 5/1981 | Iwasa et al. | 336/205 |
| 4,400,676 | 8/1983 | Mitsui | 336/205 |
| 4,560,715 | 12/1985 | Ueeda et al. | 523/443 |
| 4,760,296 | 6/1988 | Johnston et al. | 310/45 |
| 5,144,935 | 9/1992 | Taruya et al. | 123/633 |

FOREIGN PATENT DOCUMENTS

| | | |
|---|---|---|
| 126430 | 11/1976 | Japan . |
| 74727 | 6/1977 | Japan . |
| 28229 | 3/1978 | Japan . |

*Primary Examiner*—Fritz M. Fleming

*Attorney, Agent, or Firm*—Sughrue, Mion, Zinn, Macpeak & Seas

[57] ABSTRACT

An ignition coil has an inorganic insulator material featuring a larger conductivity in the direction along the surface of the material than in the direction perpendicular to the surface of the material, between high-tension voltage components internal to a casing and conducting components internal and external to the casing. Localized discharge deterioration advancing from the high-tension components toward the conducting components is changed in its direction of advance to the direction along the surface of the inorganic insulator material, and is diffused accordingly. The resistance of the ignition coil against localized discharge deterioration is increased, and improved reliability in breakdown performance is resulted. This leads to a compact design.

The casing and bobbins are constructed of mica sheet as inorganic insulator material using insert molding technique, and productivity of the ignition coil is improved.

25 Claims, 3 Drawing Sheets

IGNITION COIL INCLUDING INORGANIC INSULATOR EXHIBITING HIGHER CONDUCTIVITY ALONG ITS SURFACE THAN PERPENDICULAR TO ITS SURFACE

BACKGROUND OF THE INVENTION

1. Field of the Invention

The present invention is directed to an ignition coil, and in particular to the ignition coil that is for use in an internal combustion engine.

2. Description of the Related Art

FIG. 3 is a cross-sectional view showing the conventional ignition coil of an internal combustion engine. In FIG. 3, a primary, bobbin 1 is constructed, in the form of a cylinder, of resin material such as PBT (polybutylene terephthalate). A primary coil 2 is formed by winding conductor wire around the circumference of the primary bobbin 1. A secondary bobbin 3 is constructed, in the form of a cylinder, of resin material such as PBT, and surrounds the primary bobbin 1 with which the secondary bobbin 3 is concentric. The outer circumference of the secondary bobbin 3 is formed of circular recessed portions and projected portions, with both portions alternate with each other in a comb-like fashion. A secondary coil 4 is formed by winding in the circular recessed portions around the secondary bobbin 3, conductor wire that is substantially large in the number of turns, compared to that the primary coil 2. The secondary coil 4 is wound in a block in each circular recessed portion around the circumference of the secondary bobbin 3, thus blocks arranged axially from the rightmost recessed portion to the leftmost recessed portion along the secondary bobbin 3 in FIG. 3.

One end of the primary coil 2 is terminated with a primary terminal 5, and the other end of the primary coil 2 is terminated with a primary terminal 6. The primary terminal 5 is connected to a power supply (not shown), and the primary terminal 6 is connected to a switching element (not shown). One end of the secondary coil 4 is terminated with a secondary terminal 7 where a high tension voltage is induced. The other secondary terminal (not shown), to which the other end of the primary coil 4 is connected is connected, to the secondary terminal 5 of the primary coil 2.

A casing 8 houses both the primary bobbin 1 around which the primary coil 2 is wound and the secondary bobbin 3 around which the secondary coil 4 is wound, wherein the secondary bobbin 3 is concentric with the primary bobbin 1. The casing 8, constructed of resin such as PBT, is provided with a support 8a for supporting the secondary terminal 7 on the left-hand side and a support 8*b* for supporting the primary terminals 5, 6 on the right-hand side. A core (iron core) 9 is made of an interior portion 9*a* that extends through the primary bobbin 1 and the casing 8, an exterior portion 9*b* that is external to the casing 8 and a ring connecting portion that connects the interior portion 9*a* and the exterior portion 9*b*. The core 9 magnetically couples the primary coil 2 with the secondary coil 4. The casing 8 is filled with insulating resin 10, such as epoxy resin, so that conductor components such as the primary coil 2 and the core 9 are insulated from high tension voltage components such as the secondary coil 4 and the secondary terminal 7.

Discussed next is the operation of the ignition coil. A current is conducted to the primary coil 2 via the primary terminal 5, causing magnetic flux in the core 9. When the current conducted through the primary coil 2 is switched on and off in accordance with the ignition timing of the internal combustion engine under the control of the switching element that is connected to the primary terminal 6, a high tension voltage develops, based electromagnetic induction, at the secondary terminal 7 of the secondary coil 4 according to the ratio of the number of turns of the primary coil 2 to the number of turns of the secondary coil 4. A discharge takes place at a spark plug connected to the secondary terminal 7, driving the internal combustion engine into motion.

The insulating resin 10 filled between conductor components such as the primary coil 2, the core 9 and high-tension voltage components such the secondary coil 4, the secondary terminal 7 serves as an insulator for insulating the conductor components from the high-tension components. The insulating resin 10 filled between the high-tension components such as the secondary coil 4, the secondary terminal 7 and the casing 8 serves as an insulator between conducting devices disposed in the vicinity of the ignition coil and the high-tension components.

In the conventional ignition coil described above, however, when a high-tension voltage develops at the secondary coil 4 and the secondary terminal 7, the insulating resin 10 suffers from localized discharge that originates in cavities that may exist in a small quantity in the insulating resin 10. When localized discharges are repeated, deterioration due to localized discharges advances from the secondary coil 4 or the second terminal 7 to the primary coil 2 and the core 9 inside the casing 8, subsequently leading to a dielectric breakdown between the high-tension components, such as the secondary coil 4 and the secondary terminal 7, and the low-tension components, such as the primary coil 2 and the core 9.

In the conventional ignition coil, the insulating resin 10 thus exhibits a relatively small resistance to localized discharge deterioration, thereby lowering reliability of the device against breakdown. The relatively small resistance of the insulating resin 10 against localized discharge deterioration means a larger separation requirement between the high-tension voltage components and other components. This presents difficulty in an effort to achieve a compact design.

SUMMARY OF THE INVENTION

The present invention has been developed in view of the above problem. It is a first object of the present invention to provide an ignition coil that offers a high resistance to localized discharge deterioration exhibiting a high reliability in dielectric strength against breakdown.

It is a second object of the present invention to provide a compact-design ignition coil that offers a high resistance against localized discharge deterioration with a distance required for assuring insulation to high-tension components being minimized.

To achieve the above objects, a first aspect of the present invention comprises:a primary coil through which a primary current is conducted in an on/off manner according to ignition timing; a secondary coil magnetically coupled to the primary coil via a core, for developing a high-tension voltage for ignition by switching on and off of the primary current; a casing housing the primary and secondary coils; an insulating resin filled in the casing; and an inorganic insulator material exhibiting a higher conductivity in the direction along its surface than in the direction perpendicular to the surface, for providing insulation between the high-tension voltage section of the secondary coil inside the casing and conducting components internal and external to the casing and conducting devices external to the casing.

A second aspect of the present invention present invention comprises:a primary coil through which a primary current is conducted in an on/off manner according to ignition timing; a secondary coil magnetically coupled to the primary coil via a core, for developing a high-tension voltage for ignition by switching on and off of the primary current; electronic components including a switching element for switching on/off the primary current; a casing housing the primary, secondary coils and the electronic components; an insulating resin filled in the casing; and an inorganic insulator material exhibiting a higher conductivity in the direction along its surface than in the direction perpendicular to the surface and disposed between the high-tension voltage section of the secondary coil and the electronic components.

DETAILED DESCRIPTION OF THE PREFERRED EMBODIMENTS

Embodiment 1

Figure 1:
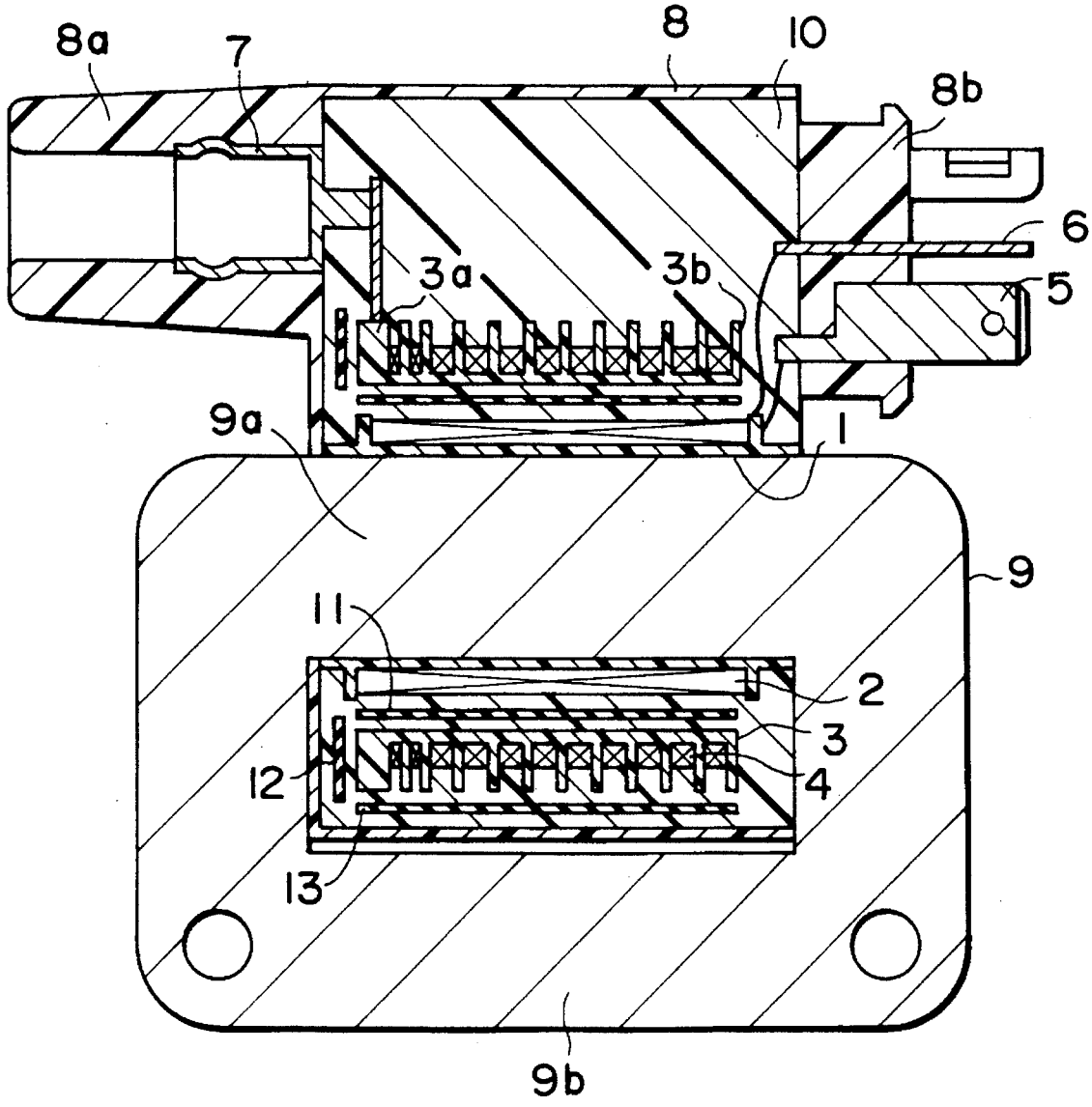
FIG. 1 is a cross-sectional view showing a first embodiment of the ignition coil according to the present invention.
Figure 3:
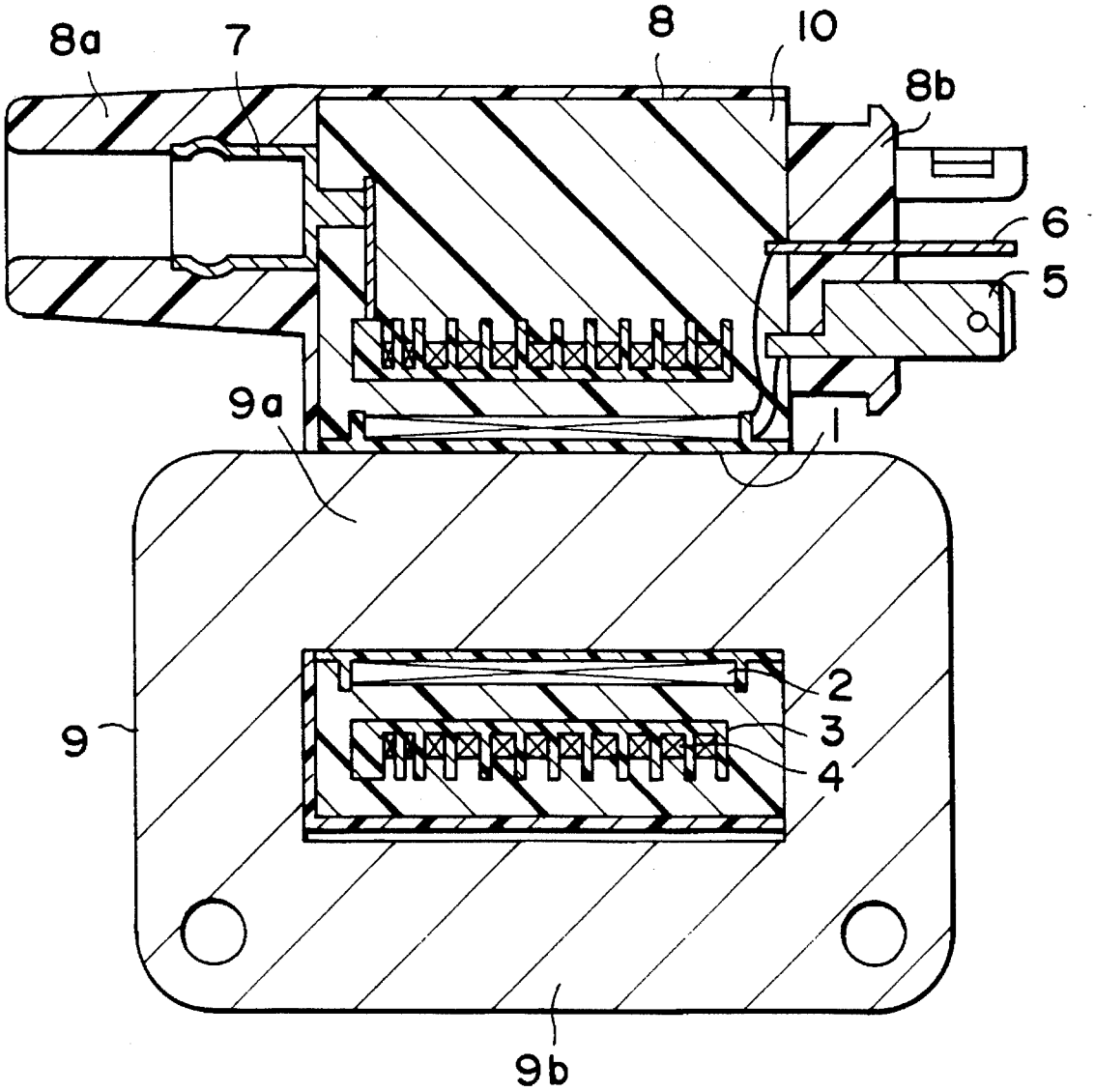
FIG. 3 PRIOR ART
FIG. 3 is a cross-sectional view showing a conventional ignition coil.

FIG. 1 is a cross-sectional view showing the first embodiment of the ignition coil according to the present invention. In FIG. 1, those components equivalent to those of the conventional ignition coil described with reference to FIG. 3 are designated with the same reference numerals, and the explanation about them will not be repeated.

In FIG. 1, a first mica sheet 11 in the form of a thin cylinder is disposed within an insulating resin 10 that fills the space between the inner circumference of a secondary bobbin 3 around which a secondary coil 4 is wound and a primary coil 2. In addition, a second mica sheet 12 in the form of a thin ring is disposed within the insulating resin 10 that fills the space between one end portion 3*a* of the secondary bobbin 3 around which the high-tension voltage side of the secondary coil 4 is wound and a casing 8. Furthermore, a third mica sheet 13 is disposed within the insulating resin 10 that fills the space between the outer circumference of the secondary bobbin 3 around which the secondary coil 4 is wound and the casing 8. The third mica sheet 13 is located where the outer circumference of the secondary bobbin 3 is close to the casing 8. The filling process of the insulating resin 8 is performed after the first, second, and third mica sheets 11, 12, and 13 are mounted inside the casing 8.

Each of the first, second and third mica sheets 11, 12, 13 is formed by cementing a plurality of mica strips, which are insulating inorganic material, in the form of a film, using insulating cementing material such as epoxy resin. The plurality of mica strips, in this case, are cemented into a unitary film using epoxy resin so that the direction perpendicular to the surface of each of the first, second and third mica sheets 11, 12, and 13 agrees with the direction perpendicular to the surface of each mica strip. The mica sheets are formed by machining or bending 0.2 to 0.3 mm thick mica film thus manufactured.

The operation of the first, second and third mica sheets 11, 12, 13 is now discussed. When a current is conducted through the primary coil 2 in an on/off manner to develop a high-tension voltage at the secondary coil 4 in an on/off manner, localized discharge takes place in the secondary bobbin 3 due to cavities that exist in a small quantity in the secondary bobbin 3. Repeated localized discharges cause localized discharge deterioration in the secondary bobbin 3 and in the insulating resin 10. The localized discharge deterioration advances within the insulating resin 10 toward the primary coil 2 and reaches the first mica sheet In each mica strip, its conductivity in the direction along its surface is substantially larger than its conductivity in the direction perpendicular to its surface, and thus in the first mica sheet 11 that is constructed of a plurality of mica strips, the conductivity in the direction along the surface of the first mica sheet 11 is substantially larger than the conductivity in the direction perpendicular to the surface of the first mica sheet 11.

The localized discharge deterioration advances along the surface of the first mica sheet 11 rather than in the direction perpendicular to the surface of the first mica sheet 11. Namely, the localized discharge deterioration spreads in the insulating resin 10 along the surface of the first mica sheet 11, and almost no deterioration reaches the primary coil 2. The possibility of the occurrence of a breakdown between the secondary coil 4 and the primary coil 2 is reduced, and the dielectric strength of the ignition coil is thus increased. The reliability of the ignition coil in terms of breakdown is thus increased. Since the use of the first mica sheet 11 results in an increased resistance against localized discharge between the secondary bobbin 3 and the primary coil 2, the secondary bobbin 3 can be located more in close proximity to the primary coil 2. Thus, a compact design is implemented in the ignition coil.

In a way similar to the operation of the first mica sheet 11, the second mica sheet 12 blocks the advance of the localized discharge deterioration immediately before the casing 8 after the localized discharge has grown from the secondary terminal 7 of high-tension voltage of the secondary coil 4 via the end portion 3*a* of the secondary bobbin 3 and the insulating resin 10. This arrangement reduces the possibility of the occurrence of a breakdown between the secondary coil 4 and the outside portion of the core 9 external to the casing 8 or conducting devices disposed in the vicinity of the ignition coil, and thus this arrangement achieves an increased reliability of the ignition coil against breakdown. Since the use of the second mica sheet 12 results in an increased resistance against localized discharge between the end portion 3*a* of the secondary bobbin 3 and the casing 8, the end portion 3*a* of the secondary bobbin 3 can be located more in close proximity to the casing 8. Thus, a compact design is achieved in the ignition coil. The operation of the third mica sheet 13 is identical to that of the first mica sheet 11 or the second mica sheet 12.

Since the voltage developed at the secondary coil 4 at the other end portion 3*b* of the secondary bobbin 3 is nearly equal to the voltage at the primary coil 2, another second mica sheet 12 external to the other end portion 3*b* of the secondary bobbin 3 may be dispensed with. When the filled quantity of the insulating resin 10 between the secondary coil 4 and the casing 8 is sufficient enough to assure insulation of the secondary coil 4, the third mica sheet 13 external to the secondary coil 4 may be dispensed with.

In the above embodiment, a mica film of 0.2 to 0.3 mm thick is used for each mica sheet. Such two or more mica films may be laminated as each mica sheet. Such a laminate of films achieves even more reinforced resistance against localized discharge. The use of a plurality of thin mica films laminated increases the ease with which the inorganic insulating mica sheets are bent and then assembled in manufacturing process. As a result, high-reliability ignition coils resistive to local discharge are manufactured in a high-productivity fashion.

Embodiment 2

In the embodiment 1, to manufacture each mica sheet, a plurality of mica strips are cemented into a film using epoxy resin, and the mica sheet is inserted into the insulating resin 10. In the embodiment 2, however, the similarly manufactured mica sheets are integrally mounted onto the casing 8 and the secondary bobbin 3 using insert molding technique.

In the embodiment 2, by mounting a mica sheet such as the first mica sheet 11 in a mold and by charging PBT into the mold, a second bobbin 3 having integrally the mica sheet inside is manufactured. Similarly, insert molding technique is applied to manufacture the casing 8 having integrally mica sheets each of which faces the end portion 3*a* of the secondary bobbin 3 and the outer circumference of the secondary bobbin 3. The secondary bobbin 3 and the casing 8 thus manufactured constitute an ignition coil.

According to the embodiment 2 of the present invention, the mica sheets that are insert-molded onto the casing 8 and the secondary bobbin 3 prevent breakdown arising from localized discharge and offer the advantage identical to that of the embodiment 1 which also has the first, second and third mica sheets within the insulating resin 10.

In the molding process of the casing 8 and the secondary bobbin 3, the mounting of the mica sheets is completed. Complex mounting process of the first, second and third mica sheet 11, 12, 13 is thus dispensed with. This results in an improved productivity of the ignition coil.

In the embodiment 2, the casing 8 and the secondary bobbin 3 are insert-molded. One mica sheet may be insert-molded onto either the casing 8 or the secondary bobbin 3, and remaining ones of the first, second and third mica sheets may be inserted into the insulating resin 10.

Embodiment 3

In the embodiment 1, to manufacture each mica sheet, a plurality of mica strips are cemented into a film using epoxy resin, and the mica sheet is inserted into the insulating resin 10. In the embodiment 3 of an ignition coil, however, the casing 8 and secondary bobbin 3 are constructed of PBT mixed with mica strips using injection molding technique.

It is known that PBT mixed with a mica strip content of 15% by weight exhibits an increased breakdown voltage, compared to PBT with no mica strip content.

Since, according to the embodiment 3, the casing 8 and the secondary bobbin 3 are constructed of mica strip mixed PBT using injection molding technique, the resulting ignition coil offers the advantage identical to that of the embodiment 1 in which the first, second and third mica sheets 11, 12, 13 are inserted into the insulating resin The casing 8 and the second bobbin 3 have already a large dielectric strength, complex mounting process of the first, second and third mica sheets 11, 12, 13 is dispensed with. This results in an improved productivity of the ignition coil. In the embodiment 3, the casing 8 and the secondary bobbin 3 are constructed of mica strip mixed PBT using injection molding technique. Alternatively, either the casing 8 or the secondary bobbin 3 may be constructed of mica strip mixed PBT using injection molding technique, and any required ones of the first, second and third mica sheets 11, 12, and 13 may inserted into the insulating resin 10.

Embodiment 4

Figure 2:
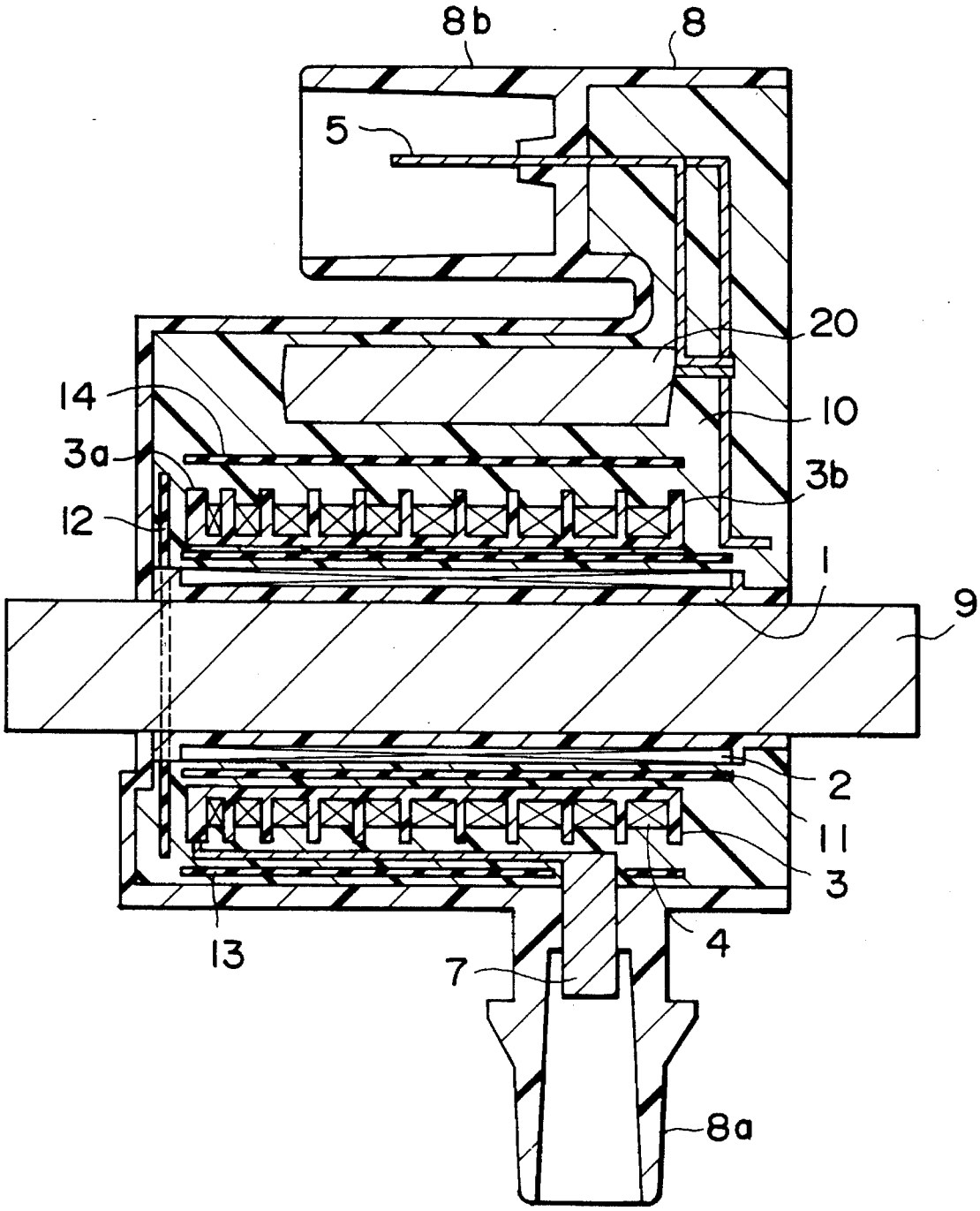
FIG. 2 is a cross-sectional view showing a fourth embodiment of the ignition coil according to the present invention.

FIG. 2 is a cross-sectional view showing the embodiment 4 of the ignition coil according to the present invention. In FIG. 4, those components equivalent to those of the ignition coil described with reference to FIG. 1 are designated with the same reference numerals, and the explanation about them will not be repeated.

The ignition coil has in the casing 8 a switching element 20 as the electronic components that switch on and off the current conducted through the primary coil 2. The ignition coil has also a fourth mica sheet 14 between the switching element 20 and the outer circumference of the secondary coil 4. The construction and the operation of the fourth mica sheet 14 are identical those of the first, second and third mica sheets 11, 12, and 13.

The fourth mica sheet 14 has a function of blocking localized discharge deterioration that advances within the insulating resin 10 from the secondary coil 4 toward the switching element 20 and preventing a breakdown that could take place from the secondary coil 4 to the switching element 20. The use of the fourth mica sheet 14 thus achieves an increased dielectric strength of the ignition coil, resulting an improved reliability. Furthermore, the use of the fourth mica sheet 14 allows the switching element 20 to be located more in proximity to the secondary coil 4. This leads to a compact design of the ignition coil. Since the switching element 20 is mounted in the casing 8 and is united with the ignition coil, the ignition coil is easy to mount onto an internal combustion engine. The reason is that the individual mounting of the switching element 20 and the connection operation of the switching element 20 to the ignition coil are dispensed with.

The switching element 20 is constructed of, for example, a power transistor, and is connected to any conductor corresponding to the primary terminal 6 in FIG. 1.

In the embodiment 4, the switching element 20 is housed in the casing 8. A similar effect will be provided if electronic components such as resistors and diodes are housed in the casing 8 with the fourth mica sheet 14 disposed between the secondary coil 4 and the resistors and diodes.

Embodiment 5

In the above embodiments, the mica sheets are used as an inorganic insulating material. A similar effect will be provided if glass sheet is used as inorganic insulating material, wherein the glass sheet is manufactured by cementing glass strips into a film using epoxy resin. Like the mica strip, the glass strip exhibits a substantially larger conductivity in the direction along the surface of the glass strip than in the direction perpendicular to the surface of the glass strip. The glass sheet thus offers the same effect as the mica sheet. Also, the resin of the casing 8 and the secondary bobbin 3 may be mixed with glass strips, and the same effect results as in mica mixed PBT.

What is claimed is:

1. An ignition coil comprising:

a primary coil through which a primary current is conducted in an on/off manner according to ignition timing;

a secondary coil magnetically coupled to said primary coil via a core, for developing a high-tension voltage for ignition by switching on and off of the primary current;

a casing housing said primary and secondary coils;

an insulating resin filled in said casing; and an inorganic insulator material exhibiting a higher conductivity in a direction along its surface than in a direction perpendicular to the surface, for providing insulation between a high-tension voltage section of said secondary coil inside said casing and conducting components which are internal and external to said casing and devices which are external to said casing.

2. The ignition coil according to claim 1, wherein said inorganic insulator material is a mica sheet that is constructed by cementing a plurality of mica strips into a film using an insulating cementing resin.

3. The ignition coil according to claim 2, wherein said insulating cementing resin is an epoxy resin.

4. The ignition coil according to claim 2, wherein said mica sheet is insert-molded to said casing and a resin-molded component inside said casing.

5. The ignition coil according to claim 1, wherein said inorganic insulator material is a laminate formed of plurality of mica films, each into which a plurality of mica strips are cemented using a cementing insulating resin.

6. The ignition coil according to claim 5, wherein said cementing insulating resin is an epoxy resin.

7. The ignition coil according to claim 1, wherein said inorganic insulator material is a mica strip, and said casing and a resin-molded component inside said casing are formed by injection molding a resin mixed with said mica strip.

8. The ignition coil according to claim 1, wherein said inorganic insulator material comprises:

a mica sheet formed as a cylinder disposed within said insulating resin between said primary coil and said secondary coil.

9. The ignition coil according to claim 1, wherein said inorganic insulator material comprises:

a mica sheet formed as a thin ring disposed within said insulating resin between one end portion of said secondary coil and said casing.

10. The ignition coil according to claim 1, wherein said inorganic insulator material comprises:

a mica sheet disposed within said insulating resin between said secondary coil and said casing.

11. The ignition coil according to claim 1, wherein said casing is constructed of an insulating resin mixed with mica strips, and wherein said secondary coil is wound on a bobbin constructed of an insulating resin mixed with mica strips.

12. The ignition coil according to claim 1, wherein said inorganic insulator material comprises a plurality of glass sheets.

13. An ignition coil comprising:

a primary coil through which a primary current is conducted in an on/off manner according to ignition timing;

a secondary coil magnetically coupled to said primary coil via a core, for developing a high-tension voltage for ignition by switching on and off of the primary current;

electronic components including a switching element for switching on and off the primary current;

a casing housing said primary, secondary coils and the electronic components;

an insulating resin filled in said casing; and an inorganic insulator material exhibiting a higher conductivity in a direction along its surface than in a direction perpendicular to the surface and disposed between a high-tension voltage section of said secondary coil and said electronic components.

14. The ignition coil according to claim 13, wherein said inorganic insulator material is a mica sheet that is constructed by cementing a plurality of mica strips into a film using an insulating cementing resin.

15. The ignition coil according to claim 14, wherein said insulating cementing resin is an epoxy resin.

16. The ignition coil according to claim 14, wherein said mica sheet is insert-molded to said casing and a resin-molded component inside said casing.

17. The ignition coil according to claim 13, wherein said inorganic insulator material is a laminate formed of plurality of mica films, each into which a plurality mica strips are cemented using a cementing insulating resin.

18. The ignition coil according to claim 17, wherein said cementing insulating resin is an epoxy resin.

19. The ignition coil according to claim 13, wherein said inorganic insulator material is a mica strip, and said casing and a resin-molded component inside said casing are formed by injection molding a resin mixed with said mica strip.

20. The ignition coil according to claim 8, wherein said inorganic insulator material comprises:

a mica sheet formed as a cylinder disposed within said insulating resin between said primary coil and said secondary coil.

21. The ignition coil according to claim 8, wherein said inorganic insulator material comprises:

a mica sheet formed as a thin ring disposed within said insulating resin between one end portion of said secondary coil and said casing.

22. The ignition coil according to claim 8, wherein said inorganic insulator material comprises:

a mica sheet disposed within said insulating resin between said secondary coil and said casing.

23. The ignition coil according to claim 8, wherein said inorganic insulator material comprises:

a mica sheet disposed within said insulating resin between said secondary coil and said electronic components.

24. The ignition coil according to claim 8, wherein said casing is constructed of an insulating resin mixed with mica strips, and wherein said secondary coil is wound on a bobbin constructed of an insulating resin mixed with mica strips.

25. The ignition coil according to claim 8, wherein said inorganic insulator material comprises a plurality of glass sheets.

* * * * *